US010272667B2

(12) United States Patent
Hoffman, Jr. et al.

(10) Patent No.: US 10,272,667 B2
(45) **Date of Patent: *Apr. 30, 2019**

(54) SQUEEGEE HOLDER

(71) Applicant: M&R Printing Equipment, Inc., Roselle, IL (US)

(72) Inventors: Richard C. Hoffman, Jr., Lake Forest, IL (US); Boguslaw W. Magda, Wheaton, IL (US); Jerzy J. Podstawka, Arlington Heights, IL (US); Remigiusz Kryszczuk, Arlington Heights, IL (US)

(73) Assignee: M&R Printing Equipment, Inc., Roselle, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/494,660

(22) Filed: Apr. 24, 2017

(65) Prior Publication Data

US 2017/0320315 A1 Nov. 9, 2017

Related U.S. Application Data

(63) Continuation of application No. 13/654,139, filed on Oct. 17, 2012, now Pat. No. 9,630,394.
(Continued)

(51) Int. Cl.
*B41F 15/44* (2006.01)
*B41F 9/10* (2006.01)
*B41F 15/46* (2006.01)

(52) U.S. Cl.
CPC ..... *B41F 15/44* (2013.01); *B41F 9/1036* (2013.01); *B41F 15/46* (2013.01); *Y10T 29/49826* (2015.01)

(58) Field of Classification Search
CPC ..... Y10T 29/49826; A47G 25/481; A47G 25/483; B41F 9/1036; B41F 15/44; B41F 15/46
See application file for complete search history.

(56) References Cited

U.S. PATENT DOCUMENTS 2,310,177 A * 2/1943 Horton ..... B21D 53/00 15/245
2,881,698 A 4/1959 Graham
(Continued)

FOREIGN PATENT DOCUMENTS

CH 376083 3/1964
DE 159416 C 2/1904
(Continued)

OTHER PUBLICATIONS

European Patent Office, International Search Report for PCT/US2013/054901, dated Dec. 4, 2013 (5 pages).
(Continued)

*Primary Examiner* — Matthew G Marini
*Assistant Examiner* — Quang X Nguyen
(74) *Attorney, Agent, or Firm* — Joseph A. Fuchs; Greensfelder, Hemker & Gale, P.C.

(57) ABSTRACT

In an embodiment of the present invention, a squeegee blade holder has a first side member, a second side member, and a pivot portion between the first and second side members. The holder also includes a separator between the first and second side members for maintaining compression of the side members against the squeegee blade.

19 Claims, 6 Drawing Sheets

Related U.S. Application Data

(60) Provisional application No. 61/684,338, filed on Aug. 17, 2012.

(56) References Cited

U.S. PATENT DOCUMENTS

| | | | | |
|---|---|---|---|---|
| 3,590,736 | A | 7/1971 | Malek | |
| 3,955,501 | A | 5/1976 | Bubley et al. | |
| 3,988,986 | A | 11/1976 | Zimmer | |
| 4,080,893 | A | 3/1978 | Wedell | |
| 4,102,266 | A | 7/1978 | Porth | |
| 4,121,519 | A | 10/1978 | Porth | |
| 4,216,716 | A | 8/1980 | Zimmer | |
| 4,389,936 | A | 6/1983 | Jaffa et al. | |
| 4,509,455 | A | 4/1985 | Shirataki | |
| 5,027,703 | A | 7/1991 | Hancy | |
| 5,165,339 | A | 11/1992 | Hoffman et al. | |
| 5,275,100 | A | 1/1994 | Harpold et al. | |
| 5,285,724 | A | 2/1994 | Kobayasi et al. | |
| 5,383,400 | A | 1/1995 | Szyszko | |
| 5,392,705 | A | 2/1995 | Jaffa | |
| 5,485,781 | A | 1/1996 | Rovaris | |
| 5,503,067 | A | 4/1996 | Jaffa | |
| 5,595,113 | A | 1/1997 | Daniel et al. | |
| 5,595,331 | A | 1/1997 | Leistner | |
| 5,603,263 | A | 2/1997 | Dufour et al. | |
| 5,649,479 | A | 7/1997 | Hoffman | |
| 5,722,321 | A | 3/1998 | Szyszko et al. | |
| 5,802,970 | A | 9/1998 | Tani | |
| 6,142,070 | A | 11/2000 | Hoffman, Jr. et al. | |
| 8,001,888 | B2 | 8/2011 | Chen | |
| 8,061,569 | B2 * | 11/2011 | Sugita | A47G 25/485 223/91 |
| 2006/0266234 | A1 | 11/2006 | Weber et al. | |
| 2009/0293744 | A1 | 12/2009 | Chen | |

FOREIGN PATENT DOCUMENTS

| | | | | |
|---|---|---|---|---|
| DE | 4421350 | A1 | 12/1995 | |
| DE | 4421350 | C2 * | 4/2002 | B05C 11/044 |
| JP | 58-59081 | | 4/1983 | |
| JP | 59-185651 | | 10/1984 | |
| JP | 63-154350 | | 6/1988 | |
| JP | 3-86548 | | 4/1991 | |
| JP | 4-288235 | | 10/1992 | |
| JP | 5-77393 | | 3/1993 | |
| JP | 5-200976 | | 8/1993 | |
| JP | 6-39999 | | 2/1994 | |
| JP | 8-39766 | | 2/1996 | |
| JP | 8-207243 | | 8/1996 | |

OTHER PUBLICATIONS

European Patent Office, Written Opinion of the International Searching Authority for PCT/US2013/054901, dated Dec. 4, 2013 (5 pages).

* cited by examiner

SQUEEGEE HOLDER

CROSS-REFERENCE TO RELATED APPLICATIONS

The present application claims the benefit of U.S. Provisional Application Ser. No. 61/684,338, filed Aug. 17, 2012, the contents of which are incorporated herein by reference.

FEDERALLY SPONSORED RESEARCH OR DEVELOPMENT

N/A

TECHNICAL FIELD

The present invention generally relates to screen printing machines and in particular to an improved squeegee holder for use with such machines. The holder facilitates changing squeegees in and out of a machine and cleaning.

BACKGROUND OF THE INVENTION

The present invention relates to a squeegee holder for use with screen printing machines. The present invention provides a versatile squeegee holder that is easily assembled and disassembled to accommodate a variety of squeegees of different types, hardnesses, and thicknesses, and to facilitate cleaning.

Indicia applied permanently to articles of clothing and other textiles have become very popular. Fanciful indicia, such as logos, slogans, college names, sports team names and sayings, are now commonplace. As a result, screen printing has become very popular. Large, commercial operations screen printing textiles are common today.

Indicia can be one or more colors. Typically, a screen printing machine has at least one station for each color employed. For example, a design incorporating two colors will have at least two printing stations, one for each color. A design employing eight colors will have at least eight stations. Each station generally includes a printing head, which supports a single screen, the ink to be used at that particular station and a mechanism for applying the ink to the textile. Each color is carried by a single screen. The textile to be screened travels from printing station to printing station by one of a number of methods, such as a chain or a rigid arm. The textile is usually carried by a metal pallet, pallet support, flat bed, or platen. Common printing machines include turret, oval and linear type machines. In addition to printing stations, there may also be curing stations to heat and set the inks placed on the textile or substrate.

In the screen printing process, a stencil screen is typically blocked (called "masked" in the industry) to embody the desired indicia and is then placed over the item to be printed. Ink of one color is then added to the screen surface and flooded onto the indicia by a flood bar of conventional design. The ink may be of any type well-known in the industry for screen printing. After the ink is flooded onto the screen, the ink is squeegeed through the screen interstices onto the item, leaving ink of the desired color where the interstices in the screen are unblocked. The squeegee is contained in a squeegee holder typically attached to a squeegee bar on the print head.

After the item is printed on, it is moved to a station where one or more operators transfer the article to a drying rack, conveyor surface leading to a dryer, or the like. This requires quick and deft handling by the operator because the cycling of the printing machine may print a shirt every four to six seconds. Further, as the articles are typically adhered to the platen with an adhesive, the article must be lifted at an angle to break the adhesive seal without smudging the print on the article.

Current squeegee holders generally require different holders for each type or hardness of squeegee and for the different types and colors of ink. Alternatively, assembly and disassembly for use with different inks or colors, or to clean the squeegee is a time-consuming task. The present invention provides a versatile squeegee holder that can be used with a variety of squeegees of different types, hardnesses and thicknesses, and provides for quick and easy assembly and attachment to a printing machine. Furthermore, the squeegee holder of the present invention permits quick and efficient disassembly and cleaning of the squeegee and holder to prevent contamination between different types or colors of ink.

Current squeegee holders also use screws to clamp the squeegee into its holder. This results in inevitable rippling effect in the squeegee caused by the screws. The present invention eliminates this rippling effect.

Of particular importance is that laws, rules and/or regulations require the thorough cleaning of squeegees. Contamination of inks is strictly prohibited. As such, there is a real need to ensure that squeegees and thoroughly and completely clean. The use of screws and other similar fasteners or clamping mechanisms have proven to difficult or extremely time consuming to clean. The present invention makes the squeegee and all of the parts associated with the holder very easy to separate and clean in standard cleaning assemblies. All parts are readily disassembled, exposed for thorough, complete cleaning, and assembled after cleaning.

SUMMARY OF THE INVENTION

In an embodiment of the present invention, a squeegee blade holder is provided. The holder includes a first side member, a second side member, and a pivot portion between the first and second side members. The holder also includes a separator or compression maintenance member between the first and second side members for maintaining a uniform compression of the side members against the squeegee sides of the blade.

In another embodiment of the present invention, a squeegee holder system is provided that includes a squeegee blade holder having a first side member and a second side member, and a pivot portion between the first and second members. The system also includes a pair of opposing clamps for compressing the side members against the squeegee blades, and a separator insertable between the first and second side members for maintaining uniform compression of the side members against the squeegee blade to hold the blade thereinbetween.

In another embodiment of the present invention, a method of holding a squeegee blade in a holder is provided. The method includes the steps of providing a first holder side, and providing a second holder side. The method further includes compressing the first and second holder sides against the squeegee blade, and maintaining compression of the first and second holder sides against the squeegee blade so as to support the blade thereinbetween.

BRIEF DESCRIPTION OF THE DRAWINGS

To understand the present invention, it will now be described by way of example, with reference to the accompanying drawings in which.

DETAILED DESCRIPTION

Figure 1:
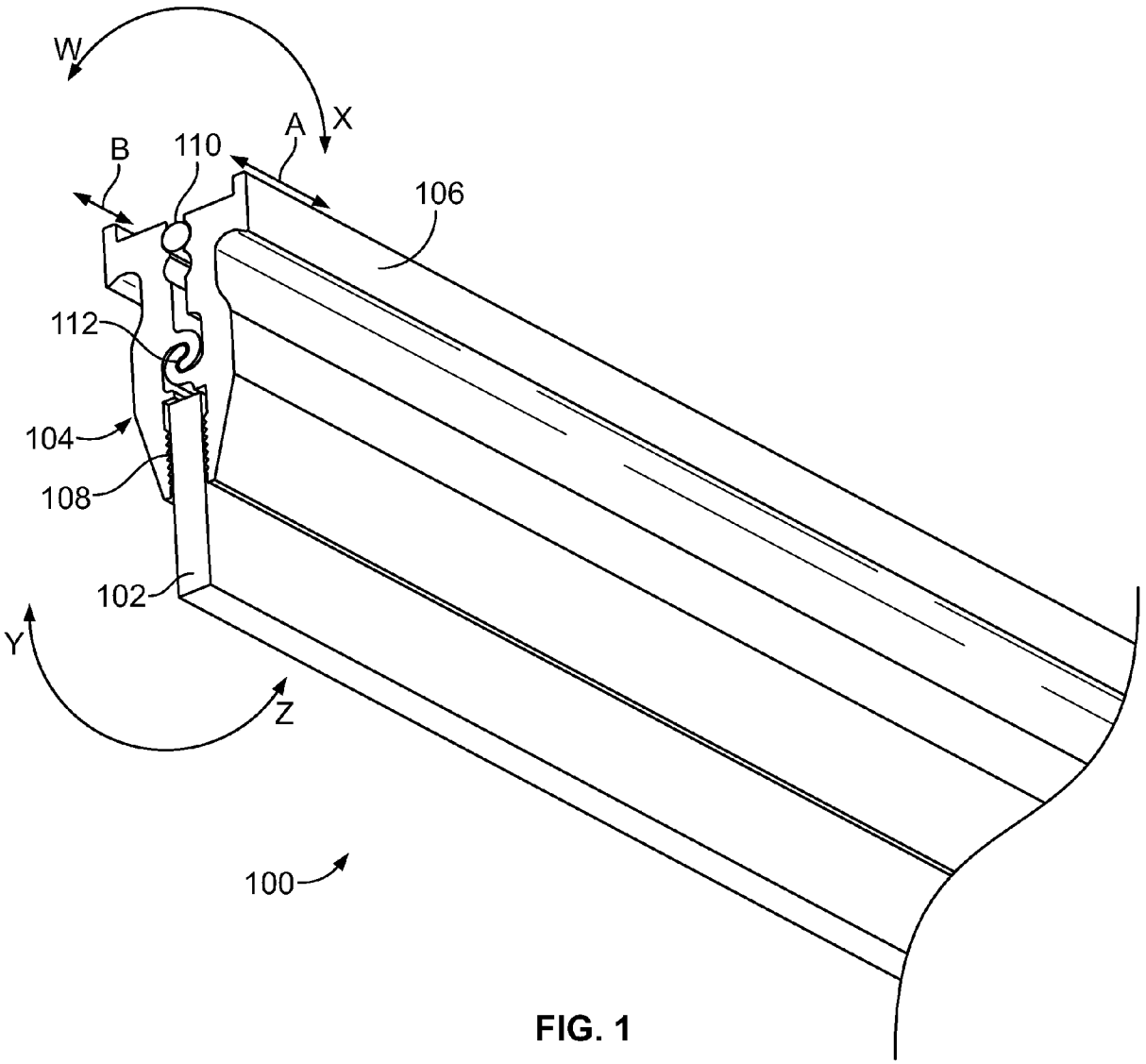
FIG. 1 is a side perspective view of a squeegee holder made in accordance with the teachings of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Shown in FIG. 1 is an improved squeegee holder 100 in accord with an embodiment of the present invention. The squeegee holder 100 includes a squeegee blade 102 and a blade holder 104. The holder 104 includes an elongated first side member 106 and an elongated second side member 108. The blade 102 is held between the first side member 106 and second side member 108. A separator or compression maintenance member 110 is used in conjunction with the first and second side members 106,108 to securely hold the blade 102 therebetween by compression. The blade 102 is preferably made from a rubber or plastic material, but can be any suitable material. As is well known in the industry, squeegees come in different durometer hardnesses and even different materials, all of which can be handled by the present holder. The blade holder 104 and separator 110 are preferably made from an extruded aluminum, but can be made from any suitable strong and rigid material. In a more preferred embodiment, the separator 110 is a magnetic stainless steel rod. While the separator is shown as a cylindrical rod, it is recognized that it can have different shapes, such as triangular, tubular, rectangular, trapezoidal, etc. It is also shown as a solid piece, but can be constructed as tubular or hollow.

In an embodiment of the present invention, the holder 104 includes a pivot portion 112. The pivot portion 112 permits the first member 106 and second member 108 to rotate relative to each other. The pivot portion 112 is also configured so that the first member 106 and second member 108 interlock or mate when they are engaged with one another while permitting them to be separated from one another.

As shown in FIG. 1, when engaged, the first elongated member 106 and second elongated member 108 can be rotated about the pivot portion 112 in the direction of Arrows W, X, Y, and Z. When the first member and/or the second member are moved in the direction of Arrows W and X, the holder clamps the blade. When the first member and/or second member are moved in the direction of Arrows Y and Z, the holder releases the blade. By moving the first member and/or second member longitudinally relative to one another in the direction of Arrows A and B while one of the members is moved in the other direction or held stationary, the members can be separated from one another. The separator 110 is inserted into a channel 212 or 214 as described below and used to hold the members 106,108 in a locked position relative to one another, clamping the blade 102 therebetween.

Figure 2:
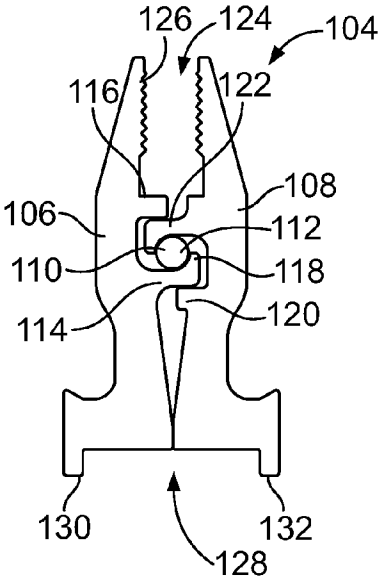
FIG. 2 is a side sectional view of the squeegee holder of FIG. 1.

Several configurations in accord with different embodiments of the present invention are shown in FIGS. 2, 4-8. In the embodiment of FIG. 2, the first side member 106 and second side member 108 pivot at pivot portion 112. Pivot portion 112 is formed by a lower ridge 114 and an upper ridge 116 on inside surface of the first side 106. The lower ridge 114 includes a lip 118. The ridges 114,116 extend along the length of the holder 104. The second side member 108 includes a lower ridge 120 and an upper ridge 122 on its inside surface. The lower ridge 120 is identical and complementary to the upper ridge 116, and upper ridge 122 is identical and complementary to lower ridge 114. The ridges 114,116,120,122 engage to form pivot portion 112 formed by the elongated (insertable and removable) separator 110. This separator 110 is placed between the lower ridge 114 of the first side 106 and the upper ridge 122 of second side 108. The first and second sides 106,108 thus pivot about the separator 110.

Squeegee blade holding portion or jaws 124 located between the first and second sides 106,108 may include serrations 126 to better grip the blade 102 therebetween and prevent any slipping. Squeegee bar attachment portion 128 is located opposite the squeegee holding portion 124. Attachment portion 128 has lips 130,132 between which the squeegee bar is located for attachment to a print head. The holder 104 may be attached to the squeegee bar through clamps, set screws, or any suitable means.

Figure 3:
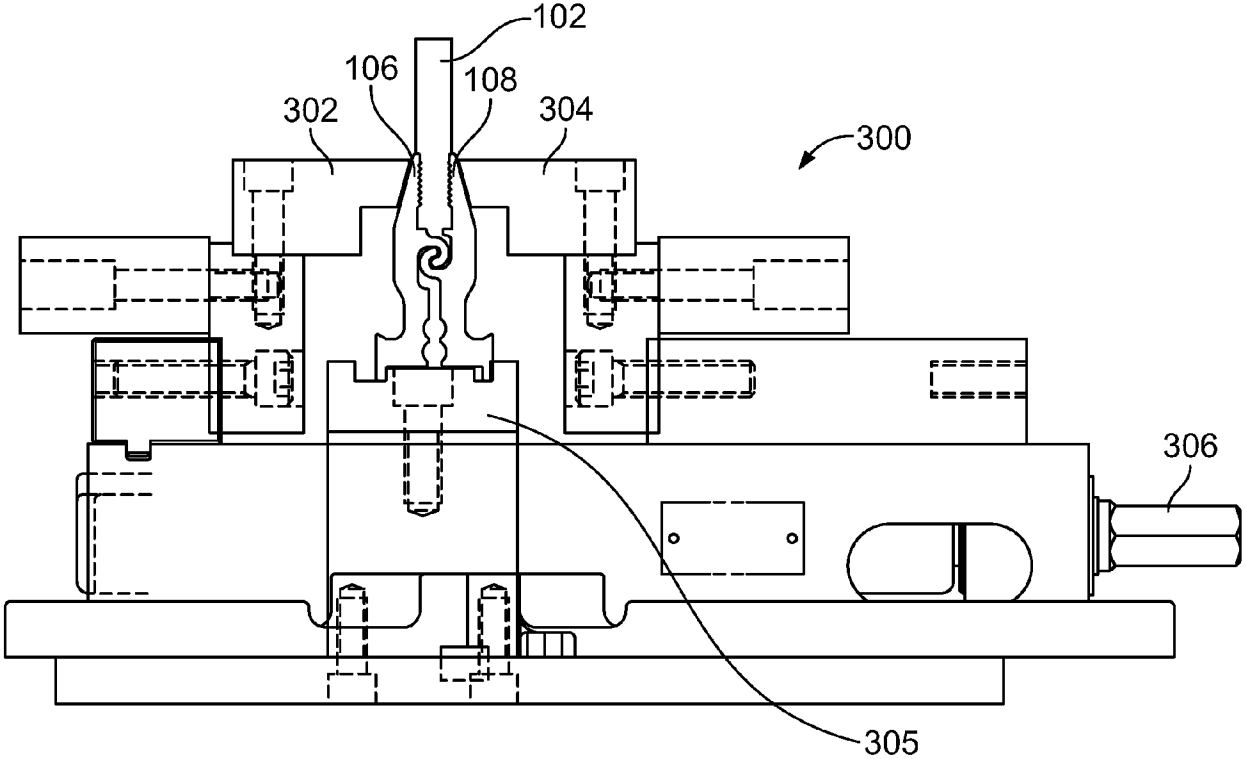
FIG. 3 is a perspective view of a vice used with a squeegee holder of the present invention.

To attach the blade 102 to the holder 104, a vise 300 can be used (FIG. 3). The vise 300 has first and second clamp elements 302,304. The first and second side members 106, 108 of the holder 104 are placed in a fixture 305 between first and second clamp elements 302,304 of the vise 300. A blade 102 is inserted between the first and second side members 106,108 of the holder 104. The first and second clamp elements 302,304 are brought together using crank 306 until they contact the first and second side members 106,108 of the holder 104 and squeeze them to compress the blade 102 therebetween. The separator or compression maintenance member 110 is then inserted and slid longitudinally into the channel 212 or 214 between first and second side members 106,108. The separator 110 is of sufficient diameter for first and second side members 106,108 to create a squeezing pressure on the blade 102 to frictionally engage and hold the blade 102 securely. Pressure on the vise 300 is then released, and the blade 102 is held between first and second side members 106,108 by compression maintained by the separator 110.

Figure 10:
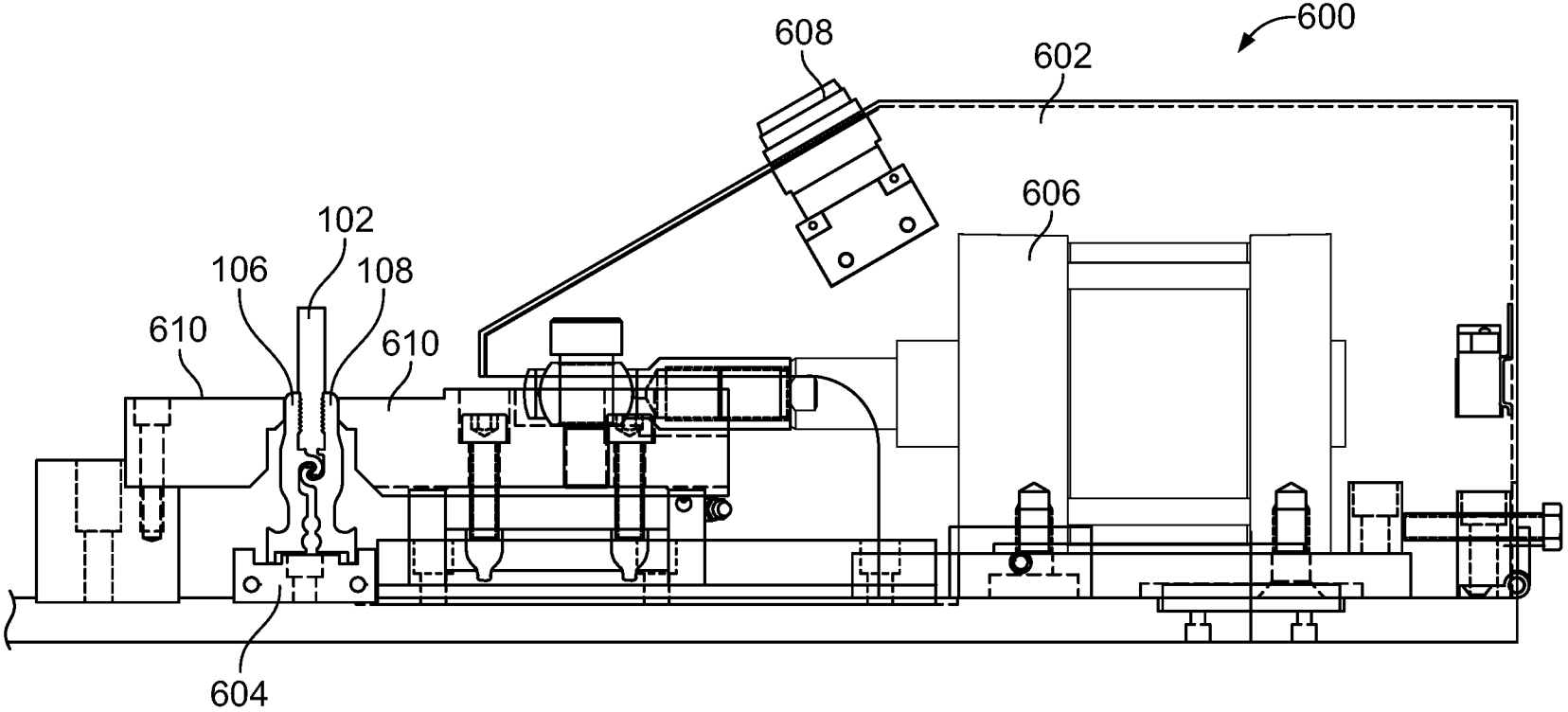
FIG. 10 is a cutaway view of an embodiment of a clamping device used with a squeegee holder of the present invention.

In another embodiment, the holder 100 is assembled and disassembled using a clamping device 600 shown in FIG. 10. The clamping device 600 includes a housing 602 and a fixture 604. The housing 600 contains pneumatic cylinders 606 and cylinder actuating switch 608. The device 600 also includes opposing clamps 610. The clamps 610 are pneumatically actuated to close and open using the switch 612 and cylinders 606. A set of two switches 608 can be used to prevent a user's hands or other objects from getting caught when actuating the cylinders 606 and clamps 610.

The first and second side members 106,108 are inserted into the fixture 604 such that the blade holding portion or jaws 124 are facing upward. A blade 102 is then inserted between the first and second side members 106,108. The switch 612 is activated, which causes pressure to be applied to the top portions of the first and second side members 106,108 by clamps 610. The pressure also compresses the blade 102. The separator or compression maintenance member 110 is inserted in the channel 212 or 214 between the first and second side members 106,108. The separator 110 is of sufficient diameter or thickness to maintain compression of the first and second side members 106,108 on blade 104, thus securing the blade 102 between them.

The squeegee holder 104 is easily disassembled using the same device 600. To disassemble, the holder 104 is placed in the fixture 604. The clamps 610 are activated to apply compression to the upper portions of the first and second side members 106,108 sufficient to relieve pressure on the separator 110. The separator 110 is removed from the holder 104 and the holder 104 is disassembled. The separator 110 can be removed from the holder 104 by applying a magnet to one end of the separator 110 and pulling.

Figure 11:
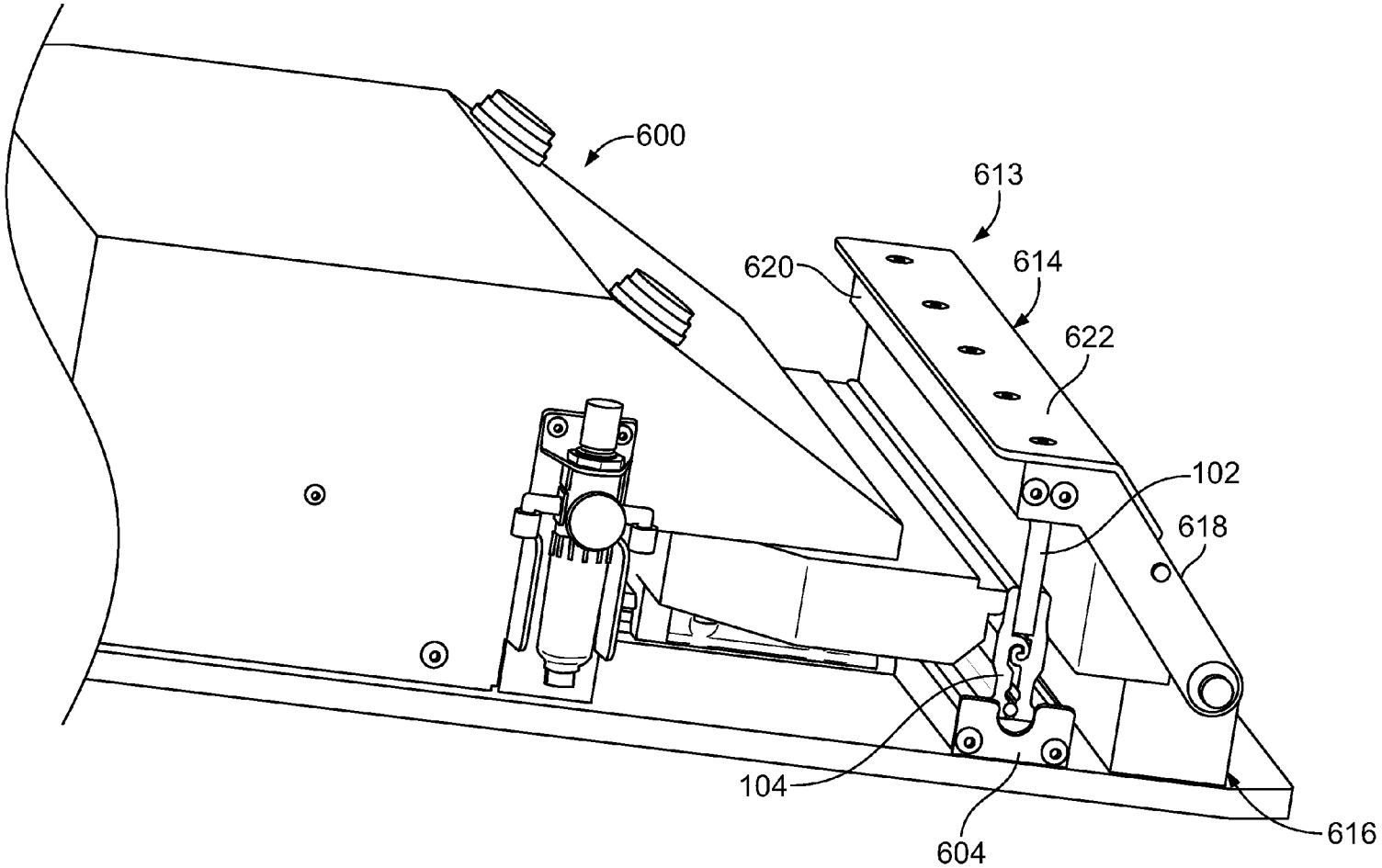
FIG. 11 is a perspective view of an embodiment of a clamping device used with a squeegee holder of the present invention.

In a further embodiment, the clamping device 600 includes a blade pressuring device 613. In the embodiment shown, blade pressuring device 613 includes a weighted swing arm 614 as shown in FIG. 11. The swing arm 614 is rotatably attached to a base 616 at a first end of push arms 618. The push arms 618 are attached at second ends to a push bar 620. The push bar 620 extends between the push arms 618. A cover 622 extends between the push arms 618 atop the push bar 620. The weighted swing arm 614 is used to push uniformly in a downward direction on the squeegee blade 102. This downward uniform pressure ensures the blade 102 is properly seated in the holder 104 during assembly. Before clamping, the swing arm 614 is swung into position such that the push bar 620 contacts the blade 102 holding it in place during the clamping operating described above. After assembly of the holder 104, the swing arm 614 is swung out of position to permit removal of the holder 104 from the fixture 604.

It should be noted that the separator 110 is firmly held in the holder 104. It does not slip out. In the absence of a vise 300 or clamping device 600, the separator 110 may be removed manually using a tap and hammer. By placing one end of the tap on the end of the separator 110 and hitting the other end of the tap, the separator 110 will slide out of the end of the holder 104. Thereafter it can be gripped and pulled totally out of the channel 212 or 214 between the two members 106,108.

Separators 110 of different diameters can further be placed in either the upper or lower separator channels 212,214. The upper and lower channels 212,214 can be of any desired diameter to allow for a range of squeegee blades 102 to be placed and held in the holder 104. For example, blades are made with different materials, in different thicknesses, and in different durometer hardnesses. The below embodiment configurations allow this.

Figure 4:
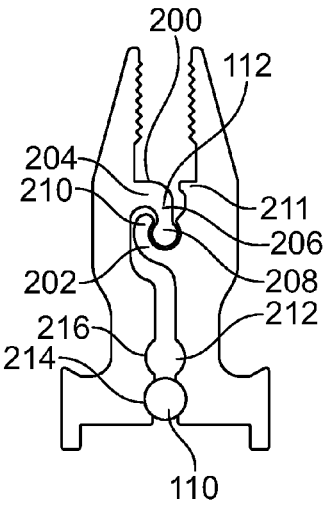
FIG. 4 is a side sectional view of another embodiment of the squeegee holder of the present invention.
Figure 5:
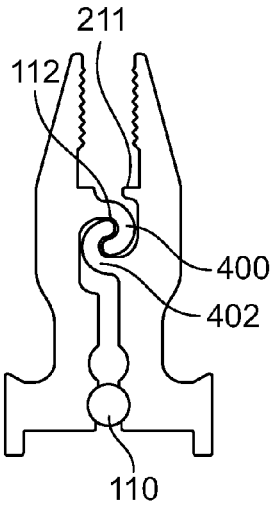
FIG. 5 is a side sectional view of a further embodiment of the squeegee holder of the present invention.
Figure 6:
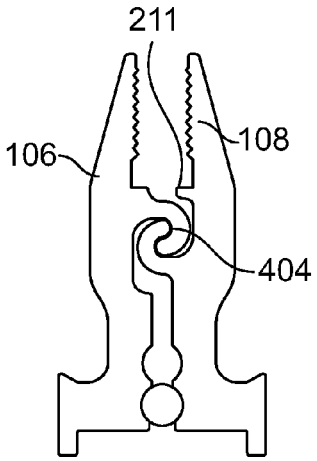
FIG. 6 is a side sectional view of a further embodiment of the squeegee holder of the present invention.
Figure 7:
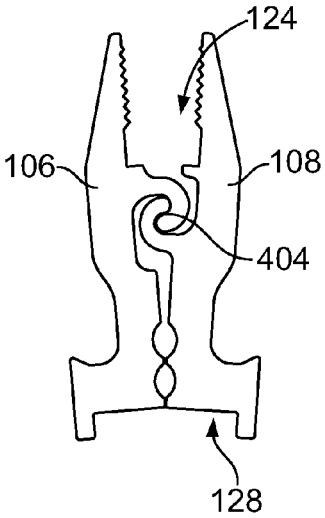
FIG. 7 is a side sectional view of an additional embodiment of the squeegee holder of the present invention.

An additional embodiment of the holder 104 is shown in FIG. 4. In FIG. 4, the pivot portion 112 is formed from a downwardly extending pivot member 200 extending from the inside surface of the first side member 106, and an upwardly extending pivot member 202 extending from the inside surface of the second side member 108. The pivot members 200,202 extend along the length of the first and second sides members 106,108, respectively.

The member 200 includes a horizontal portion 204 and a downwardly extending vertical portion 206. The vertical portion 206 has at its distal end a rounded portion 208. The member 202 includes an upwardly extending curled lip 210. The rounded portion 208 cooperates with the lip 210 to create a pivot. The second side 108 also includes a ridge 211 which limits the depth into the holder 104 which the blade 102 can sit.

In FIG. 4, the holder 104 includes channels 212, 214 proximate the portion supported by the squeegee bar attachment portion 128. The channels 212,214 are formed by grooves 216 in each of the first and second side members 106,108. The channels 212,214 are adapted to accept the separator 110. It should be noted the aligned channels 212,214 each support the separator 110. The separator 110 is inserted in the channel appropriate for the blade. For example if a blade having a first thickness or first durometer hardness is held when the separator 110 is in the first channel 214, a blade having a second thickness, which is less than the first thickness or a second durometer hardness which is softer/less than the first hardness can be held when the separator 110 is in the second channel 212.

Figure 9A:
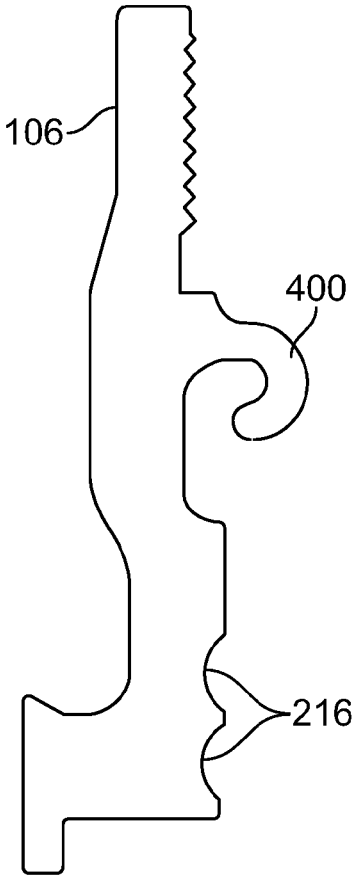
FIGS. 9*a* and 9*b* show a side sectional view of a further embodiment of the squeegee holder of the present invention.
Figure 9B:
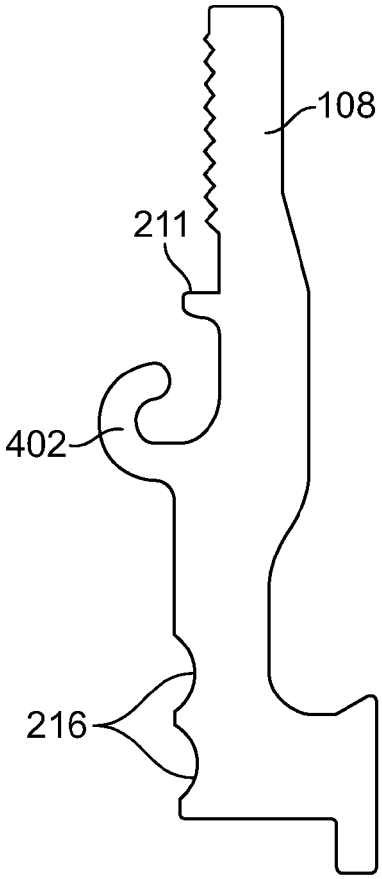

Profile or side views of an additional embodiment of the holder 104 are shown in FIGS. 5 through 7, and FIGS. 9*a* and 9*b*. This embodiment works on a principle similar to that of FIG. 4, but with a differently styled pivot portion 112. In this embodiment, the pivot portion 112 is formed from a downwardly extending curled lip 400 extending from the inside surface of the first side member 106 and an upwardly extending curled lip 402 extending from the inside surface of the second side member 108 of the holder 104. The upwardly and downwardly extending curled lips 400 and 402 engage to form a pivot 404. The embodiment of FIGS. 9*a* and 9*b* are similar to that of FIGS. 5 through 7, but have a thicker upper portion of the holder sides 106,108.

Figure 8:
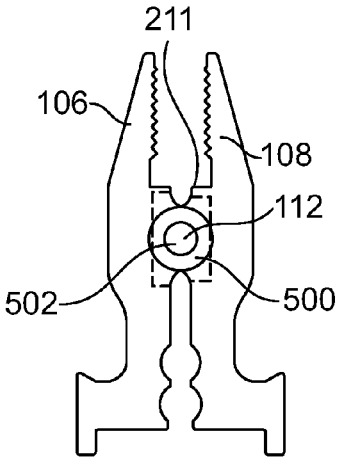
FIG. 8 is a side sectional view of a further embodiment of the squeegee holder of the present invention.

Another embodiment of the holder is shown in FIG. 8. In FIG., the pivot portion 112 includes a bushing 500 extending from the inside surface of each of the first and second side members 106,108. When the first and second side members 106,108 are arranged as in FIG. 8, a journal 502 is inserted therebetween to create a pivot about the journal 502.

Each of the embodiments of FIGS. 2 and 4 through 9 includes a squeegee blade holding portion 124 and a squeegee bar attachment portion 128. The squeegee bar attachment portion 128 attaches to a squeegee bar of a print head.

One of the significant advantages of the above designs is that the holder and blades can be easily separated and assembled to permit the cleaning and set-up of the components. Once separated, cleaning can be easy and thorough as there are no crevices or blind components. Everything is exposed for cleaning. Additionally, for other applicants such as graphics or larger scale printing, multiple squeegees and holders 104 can be used.

While the specific embodiments have been illustrated and described, numerous modifications come to mind without significantly departing from the spirit of the invention, and the scope of protection is only limited by the scope of the accompanying Claims.

What is claimed is:

1. A squeegee blade holder comprising:

a pair of arms joined at an intermediate portion of the arms by a pivot, each of the arms having a jaw at one end with a facing surface, an attachment member at a distal-most portion of an opposed end, the attachment members of both arms extend coextensively, and the pivot being positioned therebetween; and a rod between the pair of arms for biasing the first jaw toward the second jaw.

2. The squeegee blade holder of claim 1 further including a squeegee blade holding portion between the first jaw and the second jaw.

3. The squeegee blade holder of claim 1 wherein the pivot portion pivots about the rod.

4. The squeegee blade holder of claim 1 wherein the pivot portion includes a downwardly extending pivot member extending from an inside surface of the first side member of the holder, and an upwardly extending pivot member extending from an inside surface of the second side member of the holder, the downwardly and upwardly extending pivot members extending along the length of the first and second side members of the holder.

5. The squeegee blade holder of claim 4 further including a first channel formed by grooves in each of the first and second side members of the holder to accept the rod.

6. The squeegee blade holder of claim 5 wherein the first channel is positioned along a length of the first side member and between the pivot portion and the first attachment member.

7. The squeegee holder of claim 5 wherein the channel extends through the pivot portion.

8. The squeegee holder of claim 5 further comprising a second channel spaced from the first channel.

9. The squeegee blade holder of claim 1 wherein the pivot portion includes a downwardly extending curled lip extending from an inside surface of the first side member of the holder, and an upwardly extending curled lip extending from an inside surface of the second side member of the holder, the upwardly and downwardly extending curled lips engaging to form a pivot.

10. The squeegee blade holder of claim 1 further comprising serrations on the facing surface of each of the jaws.

11. A method of assembling a squeegee blade holder comprising the steps of:

providing a holder having a pair of arms joined at an intermediate portion of the arms by a pivot, each of the arms having a jaw at one end with a facing surface, an attachment member at a distal-most portion of an opposed end, and the pivot being positioned therebetween;

providing a vise having a pair of clamp elements moveable from an open position to a closed position;

inserting the jaws in the vise when in an open position;

positioning a squeegee blade between the facing surfaces of the jaws;

inserting a separator between the arms to bias the facing surfaces toward one another to clamp the squeegee blade; and moving the vise to the closed position to maintain the squeegee blade between the facing surfaces.

12. The method of claim 11 wherein the step of inserting a separator between the arms to bias the facing surfaces towards one another comprises inserting a rod in the pivot.

13. The method of claim 12 wherein the rod has a circular shape in cross-section.

14. The method of claim 13 wherein the rod is stainless steel.

15. The method of claim 13 wherein the rod is solid or hollow.

16. The method of claim 12 further comprising moving the vise to the open position after the step of inserting the rod between the arms.

17. The method of claim 12 further providing a channel between the arms for receiving the rod.

18. The method of claim 17 wherein the channel is positioned along a length of the arms between the pivot and the attachment member.

19. The method of claim 17 wherein the channel extends through the pivot.

* * * * *